United States Patent [19]

Thacker

[11] Patent Number: 4,614,051

[45] Date of Patent: Sep. 30, 1986

[54] FIREARM CONSTRUCTION

[76] Inventor: George R. Thacker, 2554 Interlaken Ct., Wexford, Pa. 15090

[21] Appl. No.: 608,578

[22] Filed: May 9, 1984

[51] Int. Cl.[4] ..... F41C 11/10

[52] U.S. Cl. ..... 42/12; 42/1.07

[58] Field of Search ..... 42/12, 1 Q, 44, 75 D

[56] References Cited

U.S. PATENT DOCUMENTS

| | | | |
|---|---|---|---|
| 51,959 | 1/1866 | Newbury | 42/12 |
| 98,579 | 1/1870 | Fox | 42/12 |
| 182,557 | 9/1876 | Castle | 42/12 |
| 414,213 | 11/1889 | Hall | 42/12 |
| 477,410 | 6/1892 | Grouleff et al. | 42/12 |
| 1,834,544 | 12/1931 | Klebe | 42/12 |
| 2,577,335 | 12/1951 | Lambert | 42/12 |
| 4,182,064 | 1/1980 | Martensson | 42/12 |
| 4,182,065 | 1/1980 | Martensson | 42/12 |
| 4,283,873 | 8/1981 | McIntyre | 42/45 |
| 4,328,635 | 5/1982 | Klavestad | 42/12 |

FOREIGN PATENT DOCUMENTS

| | | | |
|---|---|---|---|
| 1548726 | 10/1968 | France | 42/1 Q |

OTHER PUBLICATIONS

Mueller et al, "Small Arm Lexicon and Concise Encyclopedia" Shooter's Bible Inc. (South Hackensack, N.J.), publishers p. 227 (1968).

Wallack "American Shotgun Design and Performance" Winchester Press (New York, N.Y.)—p. 17 (1978).

Zuts "The Double Shotgun" Winchester Press, New Century Publishers Inc. (Piscataway, N.J.) p. 79 (1978).

*Primary Examiner*—Charles T. Jordan

*Attorney, Agent, or Firm*—Arnold B. Silverman

[57] ABSTRACT

A firearm has a barrel assembly and a breech block pivotally mounted with respect to the barrel assembly. The barrel assembly has a barrel block and a pair of barrels mounted in over and under relationship. The breech block has a generally forwardly projecting water table. Locking elements are provided for retaining the barrel assembly and breech block in desired relative relationship for firing with a portion of the locking elements being on the barrel assembly and a portion being on the breech block. In one embodiment rearwardly projecting key elements on the barrel assembly engage recesses on the breech block. A lever stem cooperates with shell head support members through cam means to urge the shell head support members forwardly when the firearm is in the firing position. Inertia firing pins may be provided in the shell head supports and intermediate firing pins may be provided in the lever stem.

35 Claims, 16 Drawing Figures

FIREARM CONSTRUCTION

BACKGROUND OF THE INVENTION

1. Field Of The Invention

The present invention relates to an improved firearm having a pair of barrels in over and under relationship and adapted to rotate about a generally vertical axis.

2. Description Of The Prior Art

In firearms such as shotguns and rifles, loading is generally effected through the breech. It has been known to provide such weapons wherein opening of the breech is effected by pivoting the barrel portion with respect to the breech block about a generally horizontal axis. With respect to firearms having two barrels positioned in an over and under relationship, the use of a horizontal axis of rotation is not entirely desirable. First of all, in over and under barrel relationship, such pivoting requires the degree of rotation to be substantial. In addition, the ejector mechanism tends to be discharging the shell in a direction toward the head of the user unless precautions are taken. This is undesirable.

It has been known with respect to either single or multiple barreled breech loading firearms to provide for opening by establishing relative rotation about a generally vertical axis. See, for example, U.S. Pat. Nos. 98,579; 182,557; 414,213; 477,410; 1,834,544; 4,182,064; 4,182,065 and 4,283,873.

U.S. Pat. No. 2,577,335 discloses a system wherein forward movement is followed by rotation about a generally vertically oriented axis.

U.S. Pat. No. 4,328,635 discloses a detachable hinge system.

It has also been known in connection with weapons of the above described type to provide various means for securing the relatively rotatable portions of the weapon in locked or firing position. U.S Pat. No. 414,213 discloses insertion of a locking bolt into engagement with a portion of the barrel construction.

U.S. Pat. No. 477,410 discloses a locking bolt which slides into engagement with a vertically oriented notch.

U.S. Pat. No. 1,834,544 discloses the use of a locking bolt which slides into interlocking engagement with a bifurcated lock-lug of the barrel construction.

U.S. Pat. No. 182,557 discloses the use of a vertical bolt which is received in an opening.

U.S. Pat. 98,579 discloses a pin and slot arrangement for effecting locking.

In spite of these disclosures, there remains a real and substantial need for a firearm having over and under relationships between barrels wherein rotation about a vertical axis is effected readily, locking is achieved automatically and additional safeguards are provided in order to provide for both safe and efficient operation.

SUMMARY OF THE INVENTION

The present invention has solved the above-described problem by providing a unique barrel assembly breech block relationship. The barrel assembly has a barrel block and a pair of barrels mounted in over and under relationship and the breech block is pivotally mounted with respect to the barrel assembly. The breech block has a generally forwardly projecting water table which is pivotally secured to the barrel assembly. Locking means are provided on the barrel assembly and breech block for cooperative interengagement.

In one embodiment a key member cooperates with a recess member to effect such locking action. In a preferred embodiment, a number of key members disposed on the barrel assembly cooperate with recesses associated with the breech block.

A shell head support associated with the breech block is adapted to be positioned adjacent to each chamber and to be urged into intimate relationship with the rear of a shell in the chamber by cam means disposed on a rotatable lever stem. The system also provides for a "left-handed" or "right-handed" version by permitting relative rotation in a first rotation but not another, should such preference be desired.

It is an object of the present invention to provide a firearm which, in an over and under barrel arrangement, permits safe, rapid and easy rotation of the barrel assembly with respect to the breech block.

It is a further object of the invention to provide such a firearm which has effective means for locking the weapon in firing position.

It is another object of the invention to provide in such a construction of a firearm effective means for engaging the rear portion of the shell to maintain the proper headspace.

It is a further object of the present invention to provide such a firearm wherein the features may be economically provided and may be used without difficulty.

These and other objects of the invention will be more fully understood from the following description of the invention on reference to the illustrations appended hereto.

DESCRIPTION OF THE PREFERRED EMBODIMENTS

As used herein, unless a specific usage contains an express contrary meaning, the term "firearm" shall refer to a breech loading weapon having two barrels disposed in over and under relationship with both barrels being shotgun barrels, both barrels being rifle barrels or one barrel being a shotgun barrel and the other being a rifle barrel.

Figure 1:
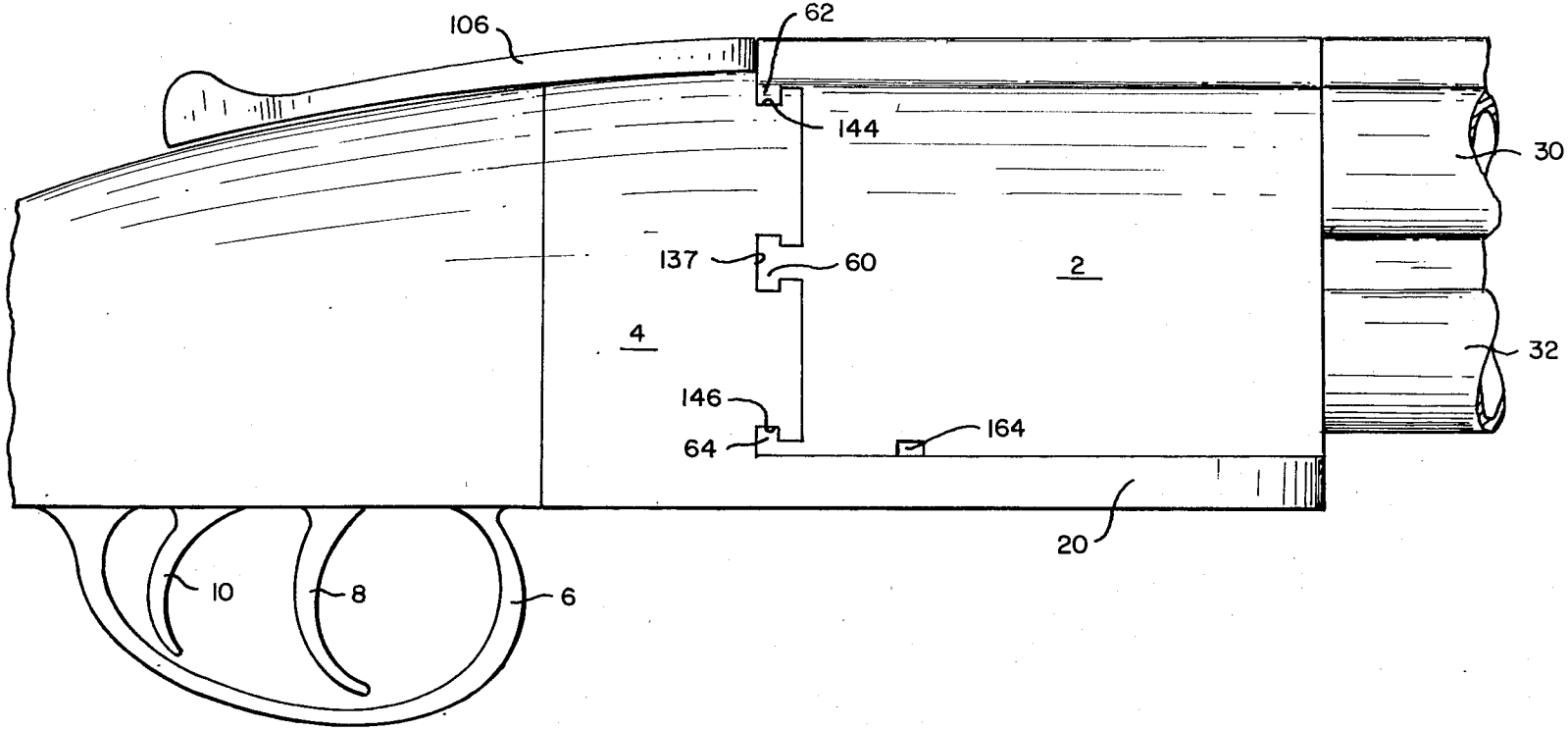
FIG. 1 is a partially schematic fragmentary elevational illustration of a form of barrel assembly and breech block of the present invention.
Figure 2:
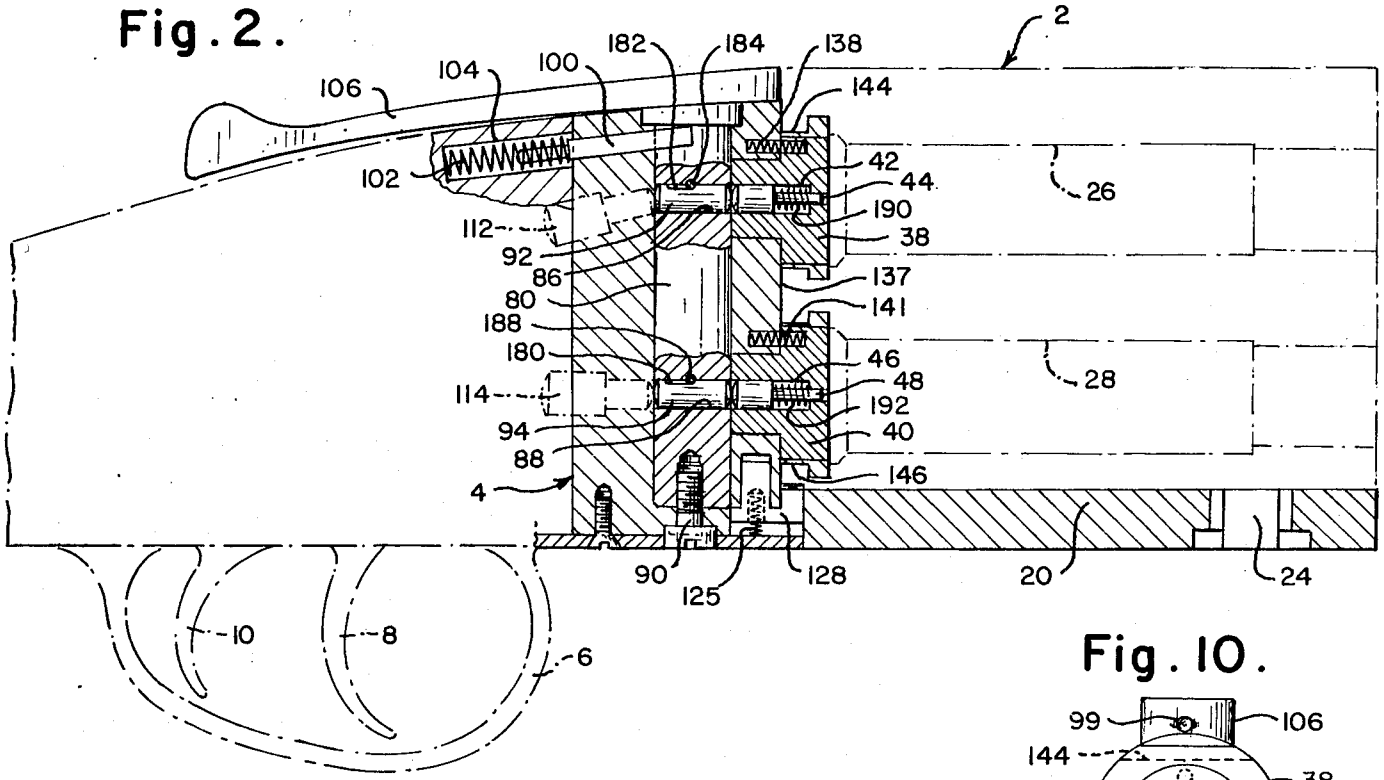
FIG. 2 is a view similar to FIG. 1, but is partly in section.

Referring more specifically to FIGS. 1 and 2, there is shown a barrel assembly 2 which is pivotally mounted with respect to breech block 4. The trigger housing 6 is secured to the breech block 4 and protectively surrounds triggers 8, 10.

Figure 16:
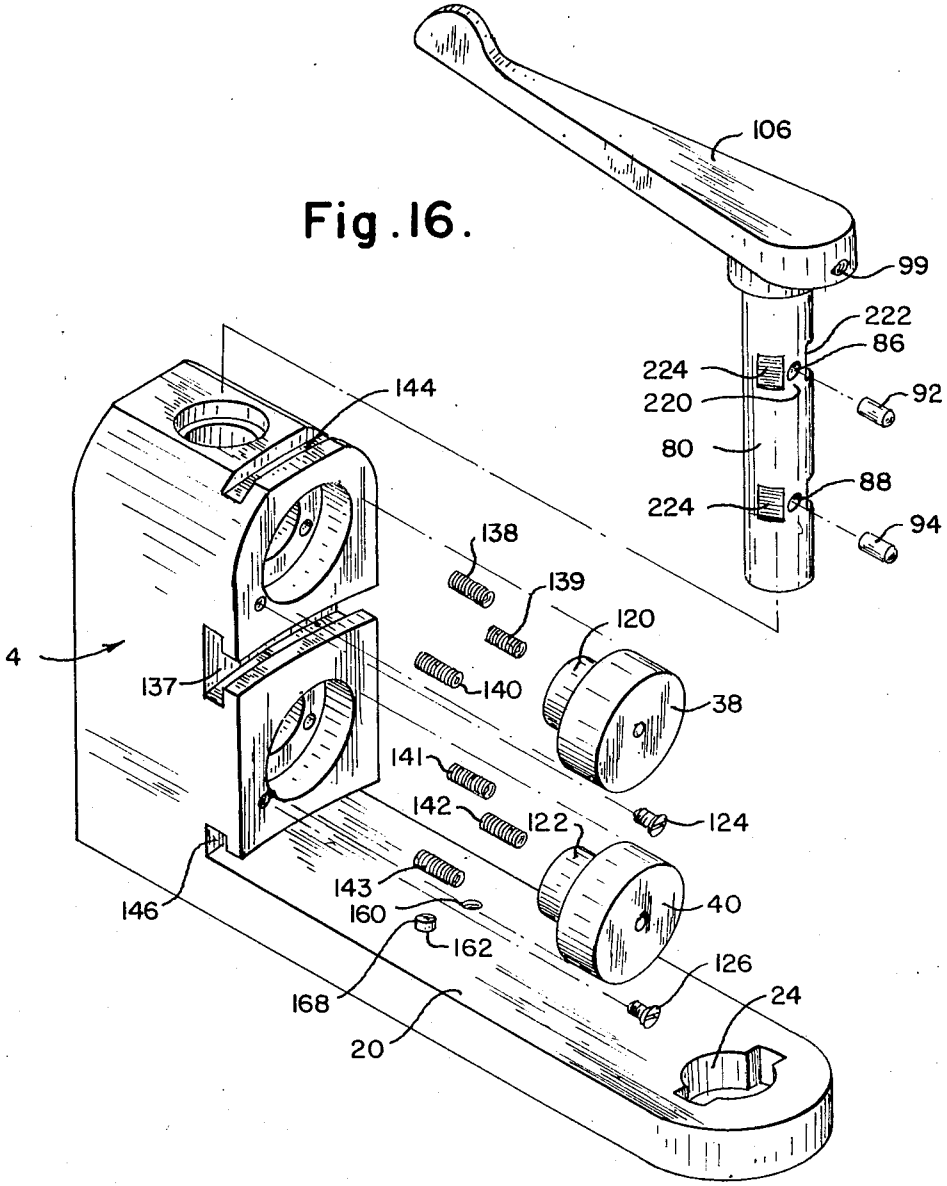
FIG. 16 is an exploded view of a portion of the breech block.

The breech block has a forwardly projecting water table 20 which underlies and preferably is in supporting contacting relationship with respect to a portion of the barrel assembly 2. In the form illustrated, adjacent to the free end of the water table 20, is an opening 24 which receives downwardly projecting pivot pin 22 (FIG. 3) which depends from the barrel assembly 2. In this manner, the axis of relative rotation is established between the barrel assembly 2 and breech block 4. As is shown in FIGS. 2 and 16, it is preferred to provide a pivot pin which is nonsymetrical which cooperates with a nonsymetrical opening. In the form shown, the pin has a pair of outwardly projecting bars which pass through corresponding extensions in opening 24. After the pin 22 has passed through the opening, it may be rotated so that the bars are not aligned with the opening extension. This serves to permit free relative rotation of the barrel assembly 2 with respect to water table 20 while resisting undesired separation of the two parts.

The barrel assembly has a pair of barrels 30, 32 with their respective chambers 26, 28 and an interposed extractor 34 which may be of any desired form.

In the form illustrated, a pair of shell head supports 38, 40 are operatively associated with the breech block 4. These shell head supports 38, 40 have a forwardly disposed generally cylindrical portion and a rearwardly disposed reduced diameter portion 120, 122.

Figure 4:
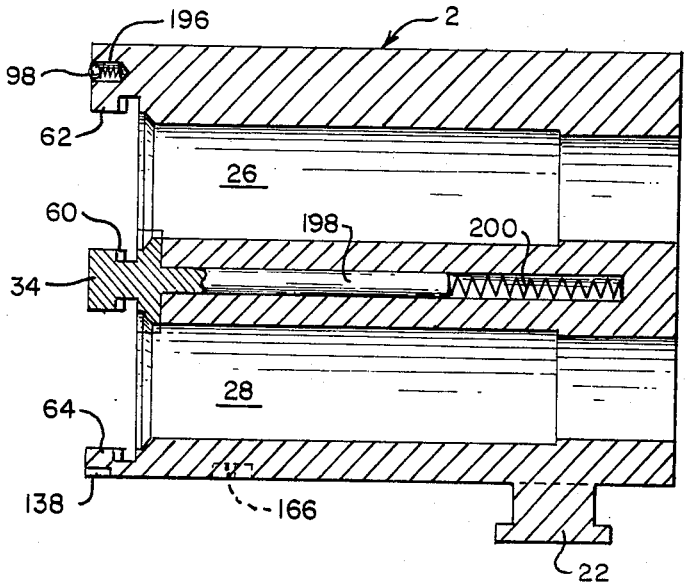
FIG. 4 is a longitudinal sectional view of a portion of a barrel assembly of the present invention taken on the line 4—4 of FIG. 5.
Figure 6:
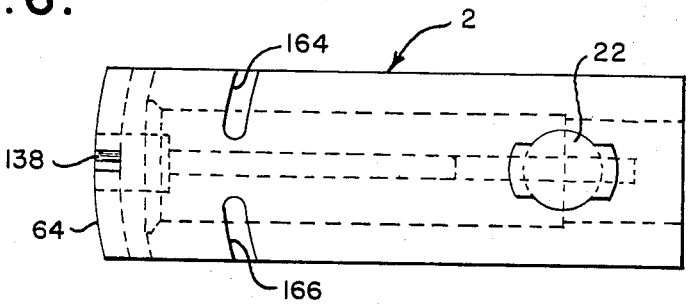
FIG. 6 is a bottom plan view of the barrel assembly of FIGS. 4 and 5.
Figure 5:
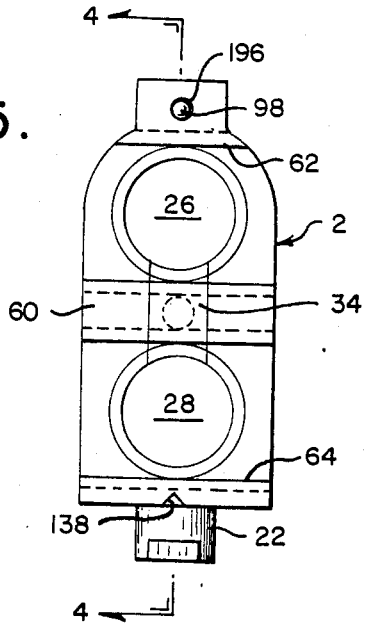
FIG. 5 is an end elevational view of the barrel assembly of the present invention.
Figure 15:
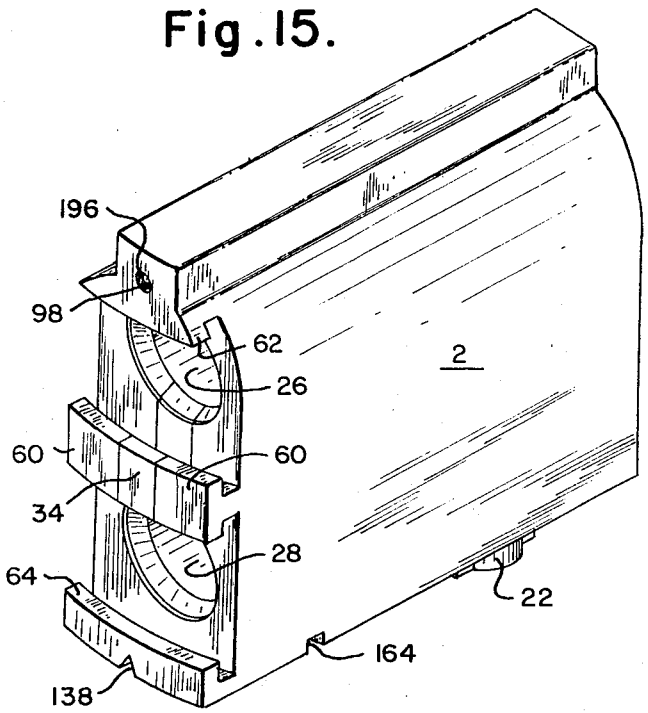
FIG. 15 is a perspective view showing a rear portion of the barrel assembly.

As is shown in FIGS. 4 through 6, the rear portion of the barrel assembly 2 has a rearwardly projecting key member 60 which in the form shown is of generally T-shaped configuration. The key member 60 is disposed at an elevation which is generally aligned with the extractor 34 and between the chambers 26, 28. The key member 60 is received within curved generally T-shaped keyway 137 (FIG. 16) In order to supplement this engagement, in the form shown, upper and lower flange members 62, 64 which are generally L-shaped are engaged within the upper and lower generally L-shaped recesses 144, 146. It will be appreciated that by rotating the barrel assembly 2 with respect to breech block 4 about pin 22, engagement or disengagement of the keys 60, 62, 64 with or from their respective recesses may be accomplished.

As is shown in FIG. 2, shell head supports 38, 40 have, respectively, stepped central bores 42, 46 with the reduced diameter portion disposed in the forward sector. Firing pins 44, 48 which have stepped diameters corresponding to the stepped bores 42, 46 are disposed within the bores.

As is shown in FIGS. 2 and 16, disposed in rearward adjacency with respect to the shell head supports is a rotatably mounted lever stem 80 which at its upper extremity is fixedly secured to lever 106 and adapted to be rotated thereby. Retainer screw 90 secures the lower end of lower stem 80 to the breech block. As is shown in FIG. 16, the lever stem has a pair of passageways 86, 88 which are generally aligned with bores 42, 46 of the shell head supports 38, 40. Disposed within the passageways 86, 88 are intermediate firing pins 92, 94, respectively. It will be appreciated that impact upon the rearward portion of the firing pins 92, 94 by strikers 112, 114 will cause the impact to be transferred from intermediate firing pins 92, 94 to firing pins 44, 48 and will thus cause detonation of the shells in the chambers 26, 28.

Figure 14:
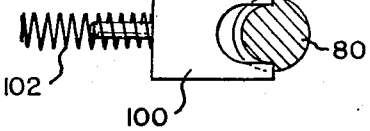
FIG. 14 is a top plan view of a lever return yoke and spring.

Referring to FIGS. 2 and 14 the top lever return yoke 100 and its associated coil spring 102 and the recess 104 defined thereby are illustrated. Spring biased yoke 100 fits into a region of circumferential relief on lever stem 80 and thereby urges the lever stem 80 and lever 106 back to the center position after the breech is closed by rotation from either direction.

Referring to FIGS. 2, 11, 12 and 13, a stop lever retaining plunger 128 is illustrated. The plunger 128 has a base 130 and a pair of generally parallel upstanding legs 132, 134 with leg 134 having a generally V-shaped upper surface 136. The upper surface 136 serves as a pilot surface to contact L-shaped flange 64 (FIG. 5) to facilitate proper interengagement of the relatively rotatable portions when the firearm is placed in shooting position. Spring 125 (FIG. 2) is received in recess 126 and urges the stop lever retaining plunger upwardly. As the barrel assembly 2 is moved to a closed position with respect to breech block 4, L-shaped flange 64 displaces plunger 128 downwardly against the bias of spring 125. Continuing closing movement will result in upper surface 136 seating in recess 138 (FIG. 5) of flange 64, thereby permitting top lever 106 to return to is center position.

Figure 3:
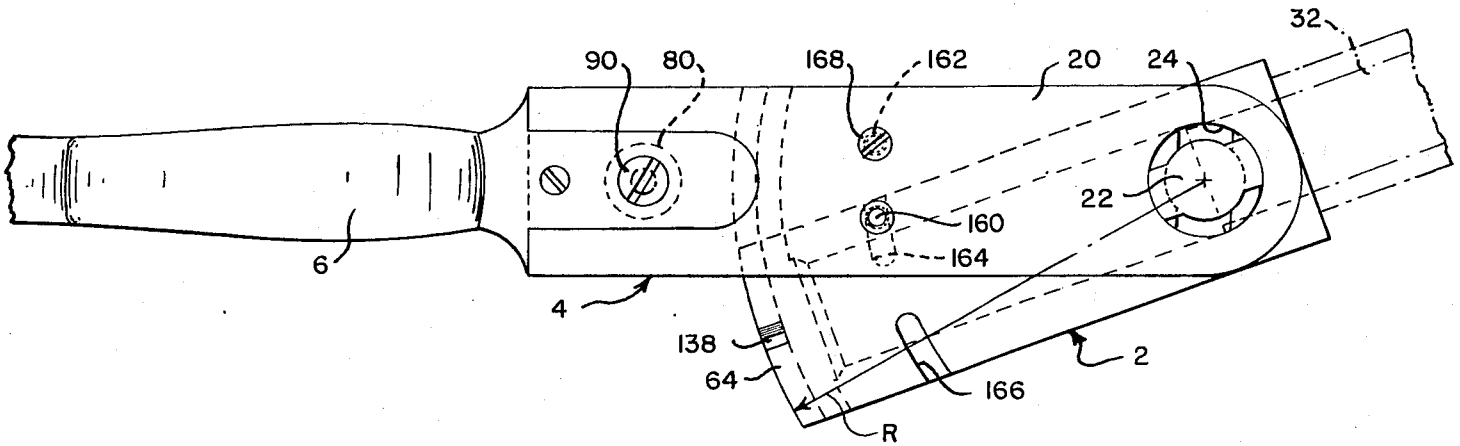
FIG. 3 is a partially schematic bottom plan view showing relative rotational movement between a barrel assembly and breech block.
Figure 7:
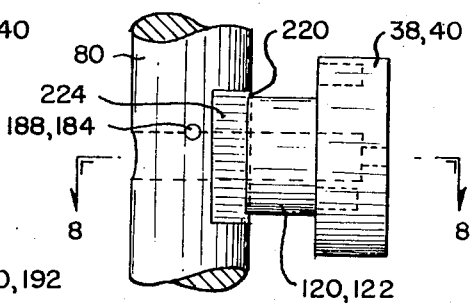
FIG. 7 is a side elevational view of a shell head support and associated lever stem of the present invention.
Figure 8:
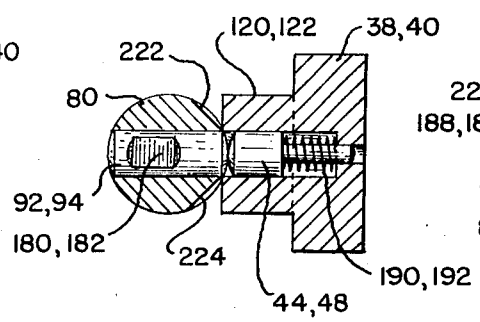
FIG. 8 is a cross-sectional view of a shell head support in combination with a lever stem taken through 8—8 of FIG. 7.
Figure 9:
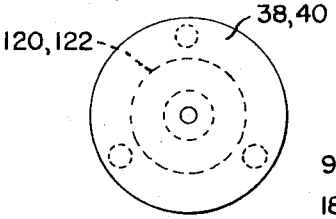
FIG. 9 is a front elevational view of a shell head support.

FIG. 3 shows a bottom plan view of the assembly with the barrel assembly 2 being in pivoted position with respect to the breech block 4. It will be noted that in this position, the chambers 26, 28 would be directed away from the user thereby permitting ejection without significant risk of the ejected shells hitting the user. It is also noted in this view that lower generally L-shaped flange 64 is curved and may have a radius R of about 2 to 3.5 inches and preferably about 2.8 to 3.1 inches. The same radii of curvature may be provided for upper L-shaped flange 62 and key element 60. The center of pivot pin 22 may be employed as the center point. This curvature serves to provide for more intimate interengagement when the weapon is in shooting position.

In order to effect more intimate securement in the closed position, it is preferred that the T bar 60 and L-shaped flanges 62, 64 are slightly convex in a rearward direction with the maximum rearward penetration being generally toward the center thereof. In a preferred embodiment, the extent of the curvature will be such that the distance between a plane passing through the ends of these members and a parallel plane pass through the rearmost portion will be about 0.055 to 0.085 inch and preferably about 0.072 to 0.0645 inch.

Referring still to FIG. 3, a further feature of the invention will be considered. The water table 20 has a pair of openings 160, 162 through which screws or other stop members may pass so as to project upwardly beyond the upper surface of water table 20. The barrel assembly has a pair of slots 164, 166 which have an open end. It will be appreciated that by providing a screw, stud or other obstruction in one of holes 160, 162, the direction of rotation of the barrel assembly 2 with respect to the breech block 4 may be limited. For example, in the form shown, a screw 168 has been threaded into opening 162 and projects upwardly. As a result, in cooperation with slot 164 which is open-ended the barrel assembly 2 is permitted to rotate in the direction illustrated, i.e, counterclockwise but clockwise rotation would be resisted by the screw 168. This sort of restriction is preferred for left-hand opening of the breech. Similarly, where it is desired to have right-hand opening a screw would have been placed in opening 160 and no screw would be present in opening 162 thereby permitting slot 166 to serve as a means for restraining rotation in one direction with the open end of the slot permitting free rotation in the other direction.

Referring again to FIG. 2, there is shown the lever stem 80 has the intermediate firing pins 92, 94 provided, respectively, with elongated grooves 182, 180, respectively, within which are positioned transversely oriented retainer pins 184, 188. This relationship serves to permit axial movement of the firing pins 92, 94 within predetermined limits.

Also shown in FIG. 2 are coil springs 190, 192 which serve to bias the inertia firing pins, 44, 48, respectively, rearwardly.

As is shown in FIGS. 4, 5, 15 and 16, a recess 196 in the barrel assembly is adapted to receive a stop pin 98 or captively retained spring biased ball member in order to secure the assembly in locked position. The stop pin 98 protrudes from the recess 196 and is spring biased so as to be received in recess 99 in top lever 106 when the barrel assembly breech block assembly is closed but to permit rotational movement to open the assembly.

As is shown in FIGS. 4–6, the extractor system which is adapted to remove spent shells generally rearwardly once the breech is open, may consist of an extractor stem 198 and a coil spring 200 biasing the stem 198 generally rearwardly. The extractor may be operated by manual means.

Figure 10:
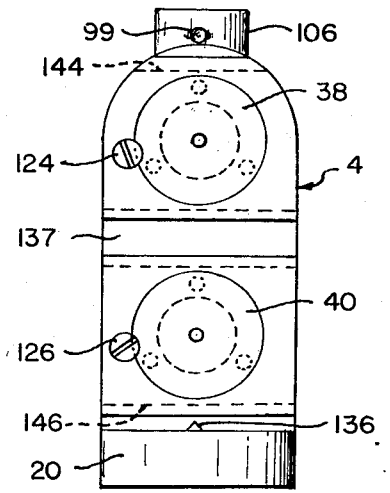
FIG. 10 is an end elevational view of the breech block as viewed from the right of FIG. 2.
Figure 12:
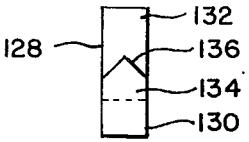
FIG. 12 is a right end elevation of the retaining plunger of FIG. 11.
Figure 11:
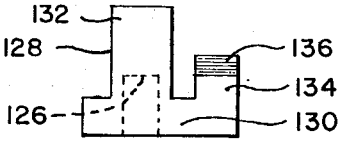
FIG. 11 is a side elevational view of a stop lever retaining plunger employed in the breech block.
Figure 13:
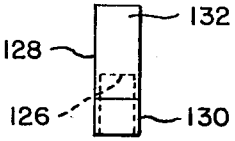
FIG. 13 is a left end elevation of the retaining plunger of FIG. 11.

Referring to FIGS. 2, 7, 8, 9, 10 and 16, further details of the lever stem 80 and the associated shell head supports will be considered. In the form shown, the shell head supports 38, 40 each have three generally rearwardly open recesses which are adapted to receive pressure springs 138–143 in order to urge the shell head support forwardly. The rearwardly projecting portions 120, 122 of the shell head supports 38, 40 have a sector engagement with the cam 220 (FIG. 7) which projects forwardly and is a portion of lever stem 80. It will be appreciated that either a continuous cam at this circumferential location or a pair of cams aligned with each of the shell head supports 38, 40 will be provided in order that when the lever stem 80 is in the position shown in FIG. 7, the shell head supports 38, 40 will be urged forward. When the lever stem 80 is in such position that the relief portions 222 or 224 are aligned with the rear portions 120, 122 of the shell head support, the lever stem 80 will not be urging the shell head supports forwardly. As is shown in FIGS. 10 and 16 retaining screws 124, 126 permit a limited degree of spring biased forward movement of shell head supports 38, 40 while not permitting complete withdrawal of supports 38, 40 from their respective associated recesses.

It will be appreciated, therefore, that the present invention has provided an effective, safe and rapid means for providing a firearm having an over and under barrel relationship while providing effective locking and pivoting in either a left or right hand direction about a vertical axis. It will further be appreciated that the present invention accomplishes this in a simple manner while providing positive mechanical features for effective retention of the assembly in locked position as well as safety features therefor.

While the preferred arrangement having key 60 and flanges 62, 64 on the barrel assembly and associated grooves on the breech block has been shown, if desired the arrangement may be reversed with the key 60 and flanges 62, 64 being on the breech block and the grooves on the barrel assembly.

Whereas particular embodiments of the invention have been described above for purposes of illustration, it will be appreciated by those skilled in the art that numerous variations of the details may be made without departing from the invention as described in the appended claims.

I claim:

1. A firearm comprising a barrel assembly having a barrel block and a pair of barrels with associated chambers mounted in over and under relationship, a breech block pivotally mounted with respect to said barrel assembly, said breech block having a generally forwardly projecting water table, pivot means for pivotally connecting said barrel assembly and said water table, said pivot means facilitating relative rotation of said barrel assembly and water table in opening in either of two directions, stop means for permitting relative rotation of said barrel assembly with respect to said breech block in a first direction while resisting relative rotation in the other direction, locking means for retaining said barrel assembly and breech block in desired relative relationship for firing said firearm, and said locking means including first locking means on said barrel assembly and second locking means on said breech block.

2. The firearm of claim 1 including one of said first and second locking means including a rearwardly projecting key member, and the other said locking means including a recess for receiving said key member.

3. The firearm of claim 2 including said first locking means having said key member and said second locking means having said recess.

4. The firearm of claim 2 including said barrels having a pair of spaced generally parallel chambers, and said key member and recess being disposed generally at a level which is between said chambers.

5. The firearm of claim 4 including said first locking means having upper and lower key members, said second locking means having upper and lower recesses for receipt of said upper and lower key members.

6. The firearm of claim 1 including said stop means being disposed between said pivot means and said breech block.

7. The firearm of claim 1 including said firearm having at least one said barrel being a shotgun barrel.

8. The firearm of claim 7 including said firearm having both barrels being shotgun barrels.

9. The firearm of claim 1 wherein said pivot means is substantially centrally located.

10. A firearm comprising a barrel assembly having a barrel block and a pair of barrels with associated chambers mounted in over and under relationship, a breech block pivotally mounted with respect to said barrel assembly, said breech block having a generally forwardly projecting water table, pivot means for pivotally connecting said barrel assembly and said water table, locking means for retaining said barrel assembly and breech block in desired relative relationship for firing said firearm, said locking means including first locking means on said barrel assembly and second locking means on said breech block, one of said first and second locking means including a rearwardly projecting key member, the other said locking means including a recess for receiving said key member, said barrels having a pair of spaced generally parallel chambers, said key member and recess being disposed generally at a level which is between said chambers, and said key member being of generally T-shaped configuration in cross section with the base portion of the T being generally horizontally oriented and the cross portion being generally vertically oriented.

11. The firearm of claim 10 including said other locking means recess having a generally T-shaped portion for receipt of said key member through relative sliding movement as said barrel assembly is rotated to closed position with respect to said breech block.

12. The firearm of claim 11 including said key member being curved and generally T-shaped.

13. The firearm of claim 12 including said key member having a radius of curvature of about 2 to 3.5 inches.

14. The firearm of claim 11 including upper and lower key members being of generally L-shaped configuration.

15. The firearm of claim 14 including an upper recess being generally upwardly open and a lower recess being generally downwardly open.

16. The firearm of claim 15 including said upper and lower key members being curved.

17. The firearm of claim 16 including said upper and lower key members having a radius of curvature of about 2 to 3.5 inches.

18. The firearm of claim 11 including said breech block defining said second locking means recess.

19. The firearm of claim 18 including said first locking means having upper and lower key members, and said breech block having recesses for receipt of said upper and lower key members.

20. The firearm of claim 19 including plunger means adapted to cooperate with said lower key member for retaining said barrel assembly and said breech block in closed position.

21. A firearm comprising a barrel assembly having a barrel block and a pair of barrels with associated chambers mounted in over and under relationship, a breech block pivotally mounted with respect to said barrel assembly, said breech block having a generally forwardly projecting water table, pivot means for pivotally connecting said barrel assembly and said water table, locking means for retaining said barrel assembly and breech block in desired relative relationship for firing said firearm, said locking means including first locking means on said barrel assembly and second locking means on said breech block, one of said first and second locking means including a rearwardly projecting key member, the other said locking means including a recess for receiving said key member, a pair of displaceable shell head supports operatively associated with said breech block, each said shell head support being aligned with one of said chambers, and spring means biasing said displaceable shell head supports toward said barrels.

22. The firearm of claim 21 including each said shell head support each having a bore passing therethrough, and an inertia firing pin disposed within each said bore.

23. The firearm of claim 22 including a generally vertically oriented lever stem disposed within said breech block rearwardly of said shell head supports.

24. The firearm of claim 23 including said lever stem being mounted for axial rotation, and said lever stem having cam means for urging said shell head supports forwardly.

25. The firearm of claim 24 including said lever stem having a pair of passageways at the same elevations as said shell head support bores, whereby positioning said lever stem at a predetermined orientation will cause said passageways to be aligned with respect to said bores.

26. The firearm of claim 25 including an intermediate firing pin disposed within each said passageway and adapted for axial movement therewithin, whereby impact applied to the rear surface of said intermediate firing pins will cause them to move forwardly and impact said inertia firing pins.

27. The firearm of claim 26 including said lever stem being so configurated that said passageways will be aligned with said shell head support bores when said cam means is in contact with said shell head supports.

28. The firearm of claim 27 including latch means for resisting undesired rotation of said lever stem.

29. The firearm of claim 23 including spring biased means for urging said lever stem to a closed position.

30. The firearm of claim 29 including pin means for retaining said barrel assembly and said breech block in closed position.

31. A firearm comprising a barrel assembly having a barrel block and a pair of barrels with associated chambers mounted in over and under relationship, a breech block pivotally mounted with respect to said barrel assembly, said breech block having a generally forwardly projecting water table, pivot means for pivotally connecting said barrel assembly and said water table, locking means for retaining said barrel assembly and breech block in desired relative relationship for firing said firearm, said locking means including first locking means on said barrel assembly and second locking means on said breech block, stop means for permitting relative rotation of said barrel assembly with respect to said breech block in a first direction while resisting relative rotation in the other direction, said stop means being disposed between said pivot means and said breech block, and said stop means having an open ended slot in one of said water table and said barrel assembly and a stud in the other said member permitting movement in a first rotational direction but not in the other rotational direction.

32. The firearm of claim 31 including said stop means having two slots with their open ends facing in opposite directions.

33. The firearm of claim 31 including a pair of displaceable shell head supports operatively associated with said breech block, and each said shell head support being aligned with one of said chambers.

34. The firearm of claim 31 including said pivot means including a downwardly projecting pivot pin secured to said barrel assembly passing through an opening in said water table.

35. A firearm comprising a barrel assembly having a barrel block and a pair of barrels with associated chambers mounted in over and under relationship, a breech block pivotally mounted with respect to said barrel assembly, said breech block having a generally forwardly projecting water table, pivot means for pivotally connecting said barrel assembly and said water table, locking means for retaining said barrel assembly and breech block in desired relative relationship for firing said firearm, said locking means including first locking means on said barrel assembly and second locking means on said breech block, one of said first and second locking means including a rearwardly projecting key member, the other said locking means including a recess for receiving said key member, a pair of displaceable shell head supports operatively associated with said breech block, each said shell head support being aligned with one of said chambers, and spring means biasing said displaceable shell head supports.

* * * * *